US009267749B1

(12) United States Patent
Dukart

(10) Patent No.: US 9,267,749 B1
(45) Date of Patent: Feb. 23, 2016

(54) FIREARM MAGAZINE PLUG

(71) Applicant: Michael Dukart, Rochester, MN (US)

(72) Inventor: Michael Dukart, Rochester, MN (US)

( * ) Notice: Subject to any disclaimer, the term of this patent is extended or adjusted under 35 U.S.C. 154(b) by 0 days.

(21) Appl. No.: 14/544,610

(22) Filed: Jan. 27, 2015

(51) Int. Cl.
*F41A 9/71* (2006.01)
*F41A 9/70* (2006.01)

(52) U.S. Cl.
CPC .... *F41A 9/70* (2013.01); *F41A 9/71* (2013.01)

(58) Field of Classification Search
CPC ..... F41A 9/71; F41A 9/65
USPC ..... 42/50, 49.02; D22/108
See application file for complete search history.

(56) References Cited

U.S. PATENT DOCUMENTS 1,041,109 A * 10/1912 Lewis ..... F41A 9/18 42/17
1,061,787 A * 5/1913 Simpson ..... F41A 9/72 42/49.01
3,371,440 A * 3/1968 Cassell ..... F41A 9/72 42/106
3,913,251 A * 10/1975 Browning ..... F41A 9/72 42/49.02
4,602,449 A * 7/1986 Holmes ..... F41A 9/72 42/49.02
5,507,110 A * 4/1996 Chesnut et al. ..... 42/50
5,568,696 A * 10/1996 Mauch et al. ..... 42/49.02
5,845,426 A * 12/1998 Valorose ..... 42/49.02
7,963,061 B2 * 6/2011 Lesenfants ..... F41A 9/71 42/49.02

* cited by examiner

*Primary Examiner* — Reginald Tillman, Jr.
(74) *Attorney, Agent, or Firm* — DL Tschida

(57) ABSTRACT

A modular firearm magazine assembly that is adapted to accept a "plug" piece to restrict and reduce the number of cartridges that can be contained in a magazine housing. The assembly in one construction is comprised of a base plate retainer collar, base plate, resistance spring, and cartridge follower plate that attach to and mount inside a cartridge magazine housing. In alternative constructions, the base plate and cartridge follower plates are modified to provide plug pieces that cooperate to restrict and limit the maximum possible travel distance of the cartridge follower plate to reduce the cartridge storage capacity of the magazine and accommodate governmental regulations.

9 Claims, 7 Drawing Sheets

FIREARM MAGAZINE PLUG

RELATED US APPLICATION DATA

Provisional application 61/965,188 filed Jan. 27, 2014.

BACKGROUND OF THE INVENTION

The present invention relates to cartridge magazines for firearms and in particular to a magazine assembly supporting removable cartridge storage limiting devices aka "plugs" which are supported in the magazine to temporarily reduce the maximum number of stored cartridges as long as the plug is fitted to the magazine.

Firearms such as rifles and shotguns are available in a variety of types, styles, calibers and gauges. The construction, cartridge size, caliber/gauge, and cartridge capacity of such arms vary depending upon the type of intended use, e.g. military, law enforcement or sporting.

Cartridge magazines for shotguns are typically the most limited and for pump or automatic shotguns typically contain from 5-12 rounds. Federal and state regulations however frequently specify that while in the field the weapon can contain only three shells. These regulations exist especially for migratory waterfowl. Plugs have therefore been developed of adapted from plastic pins, wooden pins, tree branches or the like to mount in the shotgun magazine to reduce the longitudinal storage space and thereby limit the number of shells that can be inserted into the magazine. Such plugs typically are positioned within the bore of a resistance spring mounted in the magazine.

Rifles in contrast and until recently have had no regulatory restrictions on the numbers of rounds that can be supported in a weapon's magazine. Most clips or magazines for pump or semi-automatic sporting rifles customarily contained 3 to 10 rounds in addition to a chambered round. With the growing popularity and use of semi-automatic, military type rifles however many sportsmen replace a typical original equipment manufactured (OEM) magazine designed to contain 4 to 10 cartridges with a high capacity magazine that might contain 20 to 30 cartridges. Multiple magazines may also be fastened to each other for example to permit a flip mounting of a spent magazine for a fresh/full magazine. High capacity magazines most typically are used in practice shooting venues although can be found in the field.

With the growing popularity of high capacity rifle magazines many states, municipalities and governmental regions (e.g. CA, CT, NJ, NY, MA, MD, HI, CO and D.C.) have passed laws to restrict the numbers of cartridges that can be contained in any rifle magazine attached to the rifle such as while hunting. The number of legally permitted cartridges contained in any magazine in the field can therefore vary over a wide range. It is the responsibility of the weapon owner to ascertain the particulars of these restrictions to assure compliance with the regulations.

The present invention was accordingly developed to facilitate compliance of sporting rifles with mandated regulations. The magazines of the invention are constructed to selectively tailor or adjust (i.e. reduce) the storage capacity of a high capacity rifle magazine to hold less cartridges than permitted without modification. The cartridge storage capacity of the novel magazines can therefore be tailored to meet legal requirements for field use with the placement of a suitable plug in the magazine housing, yet accommodate unrestricted target use without having to purchase multiple magazines of differing storage capacities.

The inventive magazines are constructed to support elongated plugs that permanently or detachably project from either or both of base and/or cartridge follower plates found in magazines adapted to different models and calibers of weapons. One construction of the inventive plug is permanently affixed to or adapted to semi-permanently attach to a magazine base plate. The plug piece is suspended within the bore of a resistance spring between the base plate and a moveable cartridge follower plate. The cartridge follower plate is shaped to depress into the magazine housing and align the cartridges inserted into the magazine for proper feeding into the firearm chamber. The plug defines a lower limit of movement to the follower plate and a reduce cartridge storage space.

Another construction of a plug containing magazine permanently or semi-permanently secures a plug piece to project or depend from the lower or interior surface of the follower plate. The depending plug is fitted to strike the base plate to again limit number of cartridges that can be stored in the magazine. In yet another construction, plug pieces of suitable lengths can project from both the base and follower plates and interact to control the magazine storage space.

In lieu of the plug piece striking the base and/or follower plates, the magazines can also be constructed to include flanges, protuberances, recesses or other surfaces that interact with the plug piece to restrict the travel distance of the follower plate and thereby the available internal cartridge storage space. In all instances and whether semi-permanently mounted or formed as part of the base and cartridge follower plates, the present plugs mount within the magazine to limit the depression of the cartridge follower plate and restrict the physical cartridge storage space within the magazine. The present plug configurations are particularly configured to modify the magazine storage capacity to hold only the maximum number of cartridges permitted by pertinent regulations/laws.

SUMMARY OF THE INVENTION

It is a primary object of the invention to provide a plug for a firearm magazine to restrict and limit the maximum range of depression of a cartridge follower plate to thereby restrict the physical cartridge storage space and number of cartridges storable within the magazine.

It is further object of the invention to provide a cartridge follower plate having a depending projection or protuberance that extends into a magazine housing and interacts with an interior magazine surface (e.g. base plate) to restrict the depression of the follower plate and thereby reduce the magazine storage capacity.

It is further object of the invention to provide a cartridge base plate having a projection or protuberance that extends into a cartridge magazine housing to restrict the depression of the follower plate and thereby reduce the magazine storage capacity.

It is further object of the invention to provide an elongated, length adjustable stem or plug piece that permanently or semi-permanently mounts to or extends from a base plate and/or cartridge follower plate of a cartridge housing to restrict the depression of the follower plate and thereby reduce the magazine storage capacity.

It is further object of the invention to provide an elongated plug piece that permanently or semi-permanently extends from and between a base plate and/or cartridge follower plate of a magazine housing to restrict the depression of the follower plate and thereby reduce the magazine storage capacity.

It is further object of the invention to provide one or more members or surfaces that mount between a base plate and cartridge follower plate of a cartridge housing to limit/restrict and/or tailor the range of depression of the follower plate and thereby reduce the magazine storage capacity.

The foregoing objects, advantages and distinctions of the invention are obtained in alternative, presently preferred assemblies shown at several attached figures discussed below. Each magazine assembly is constructed to include an elongated magazine housing of preferred shape having an internal cartridge storage space, a base plate that attaches to the housing, a base plate retainer collar that fastens to the end of the magazine housing, a cartridge follower plate that moves to and fro within the housing and a spring or other resilient member to resist the travel of the cartridge follower plate.

In a currently preferred configuration, an elongated plug or stem piece is formed to project from either or both of the base plate and/or the cartridge follower plate. The plug or stem piece longitudinally extends generally parallel to the bore of the spring and is permanently or semi-permanently fastened to the base plate and/or follower plate. The plug or stem piece can also mount in a condition that controls movement of the spring as it compresses, yet permits spring flexion. Fastened plug or stem pieces include formed surfaces that are suitably configured to mate or interconnect with the base and/or follower plates either in a rigid, moveable and/or detachable manner.

The length of the stem pieces can also be sized with appropriate cutting or adjusted to any preferred length in a variety of fashions. For example, including a threaded surface and providing a screwed length adjustment, a telescoping length adjustment between multiple stacked plug pieces, an interlocking stack of plug pieces that combine to preferred lengths, among a variety of other plug length fixing assemblies.

The disclosed and presently contemplated plugs and magazine combinations represent several novel constructions and embodiments of the invention. Still other objects, advantages, distinctions, constructions and considered combinations of individual features of the invention are discussed and will become more apparent from the following description with respect to the appended drawings. Other combinations can be obtained with suitable design modifications. Similar components and assemblies are referred to in the various drawings with similar alphanumeric reference characters. The description to each feature and/or combination should not be literally construed in limitation of the invention. Rather, the invention should be interpreted within the broad scope of the further appended claims.

BRIEF DESCRIPTION OF THE PREFERRED EMBODIMENT

Figure 1:
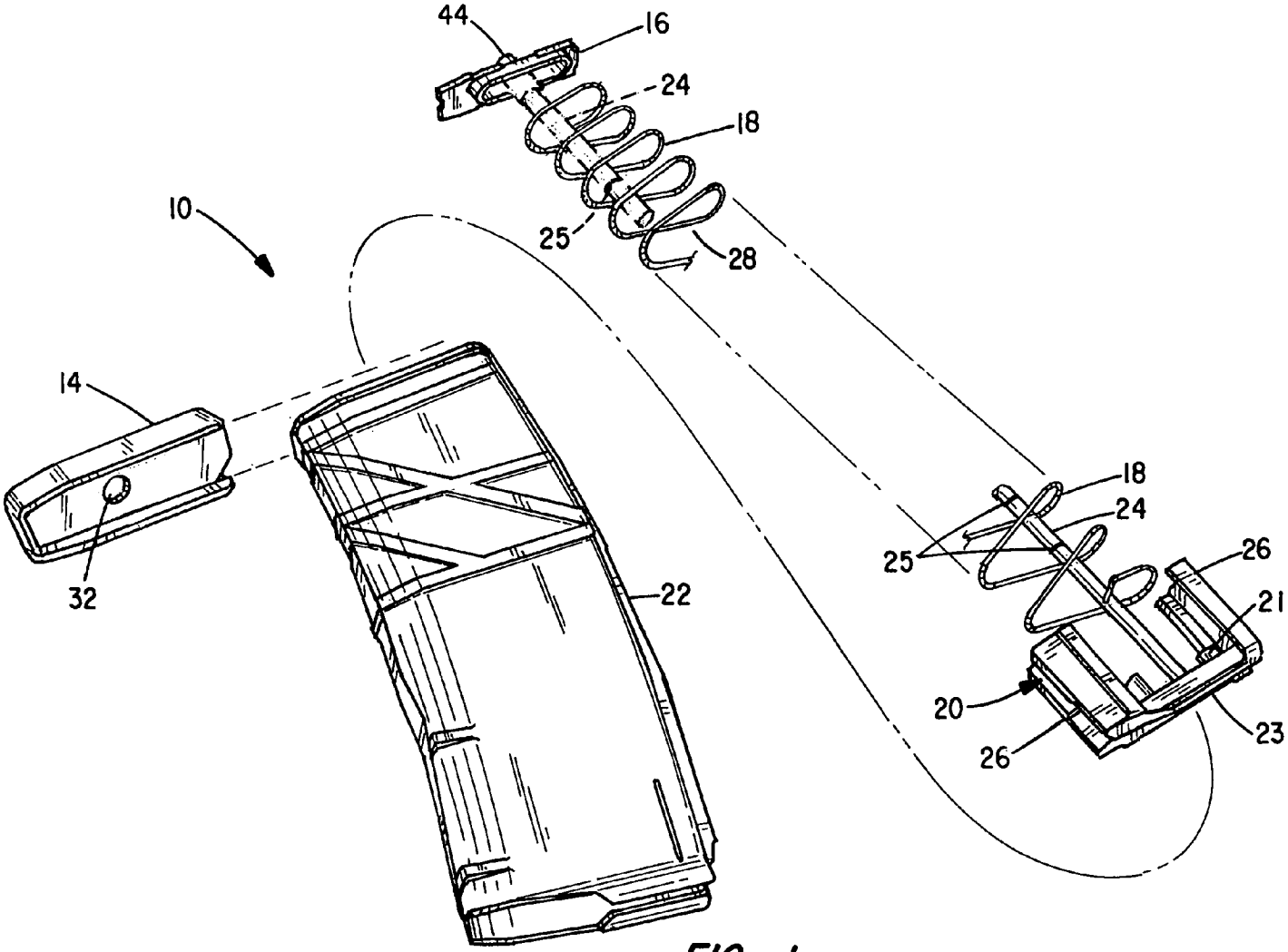
FIG. 1 is an exploded perspective assembly drawing showing a firearm cartridge magazine of the invention having a cartridge magazine housing that contains a base plate, base plate retainer collar, resistance spring, cartridge follower plate, stem or plug piece projecting from the base plate, and an alternative and/or additional stem or plug piece (shown in dashed line) depending from the cartridge follower plate.
Figure 2:
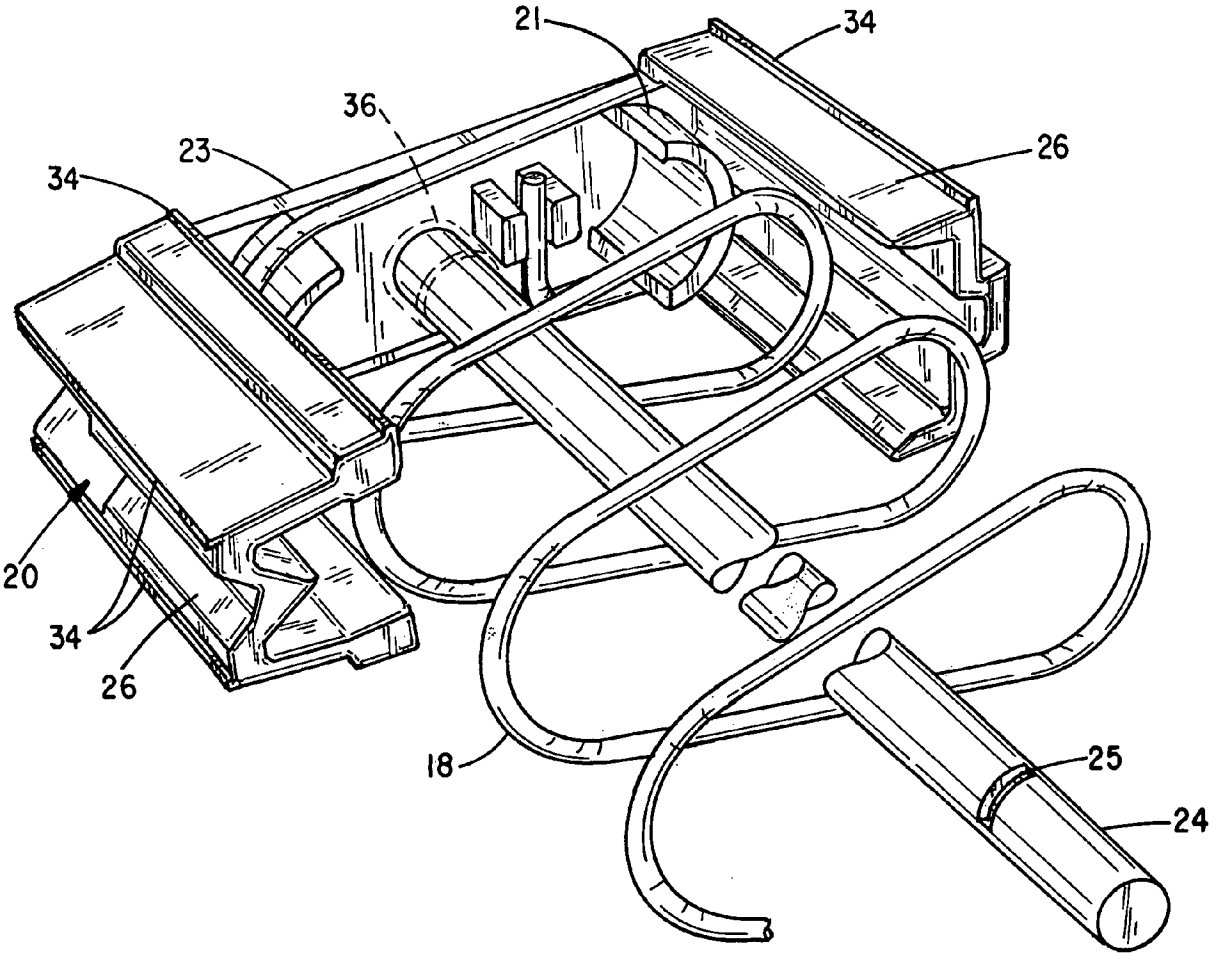
FIG. 2 is an enlarged view of the cartridge follower plate of FIG. 1 sans the cartridge magazine housing and showing a permanently mounted or semi-permanently mounted stem or plug piece (mounted to a dashed line collar) that projects into the bore of the resistance spring from a cartridge follower plate.
Figure 3:
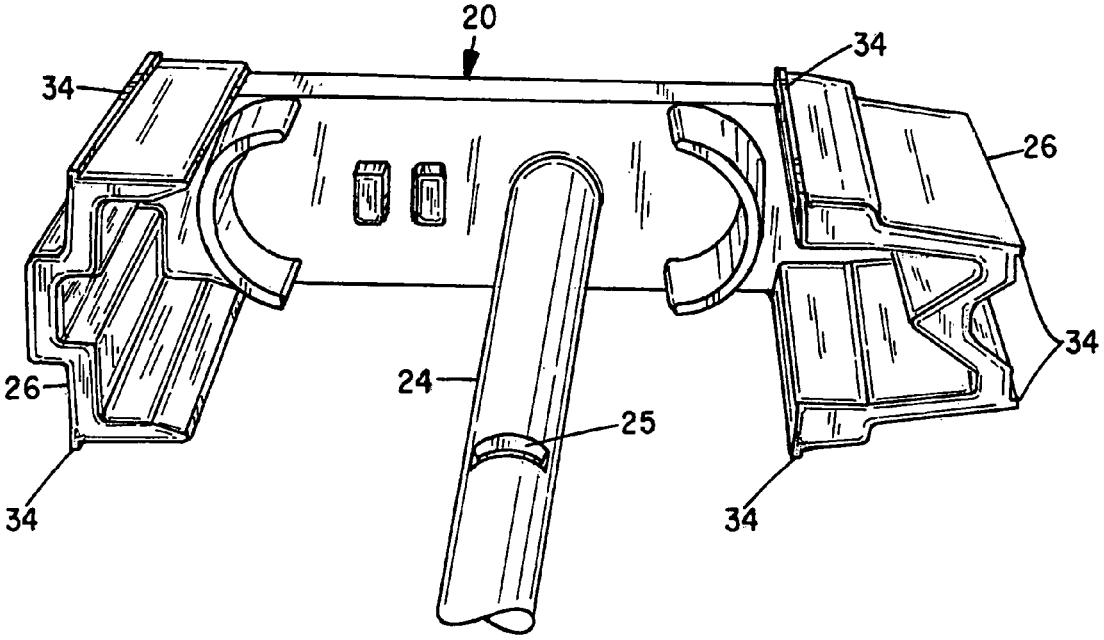
FIG. 3 is a enlarged view of the cartridge follower plate of FIG. 1 sans the cartridge magazine housing and spring from a different perspective and wherein the permanently mounted stem or plug piece is molded as part of or later affixed to the cartridge follower plate.
Figure 4:
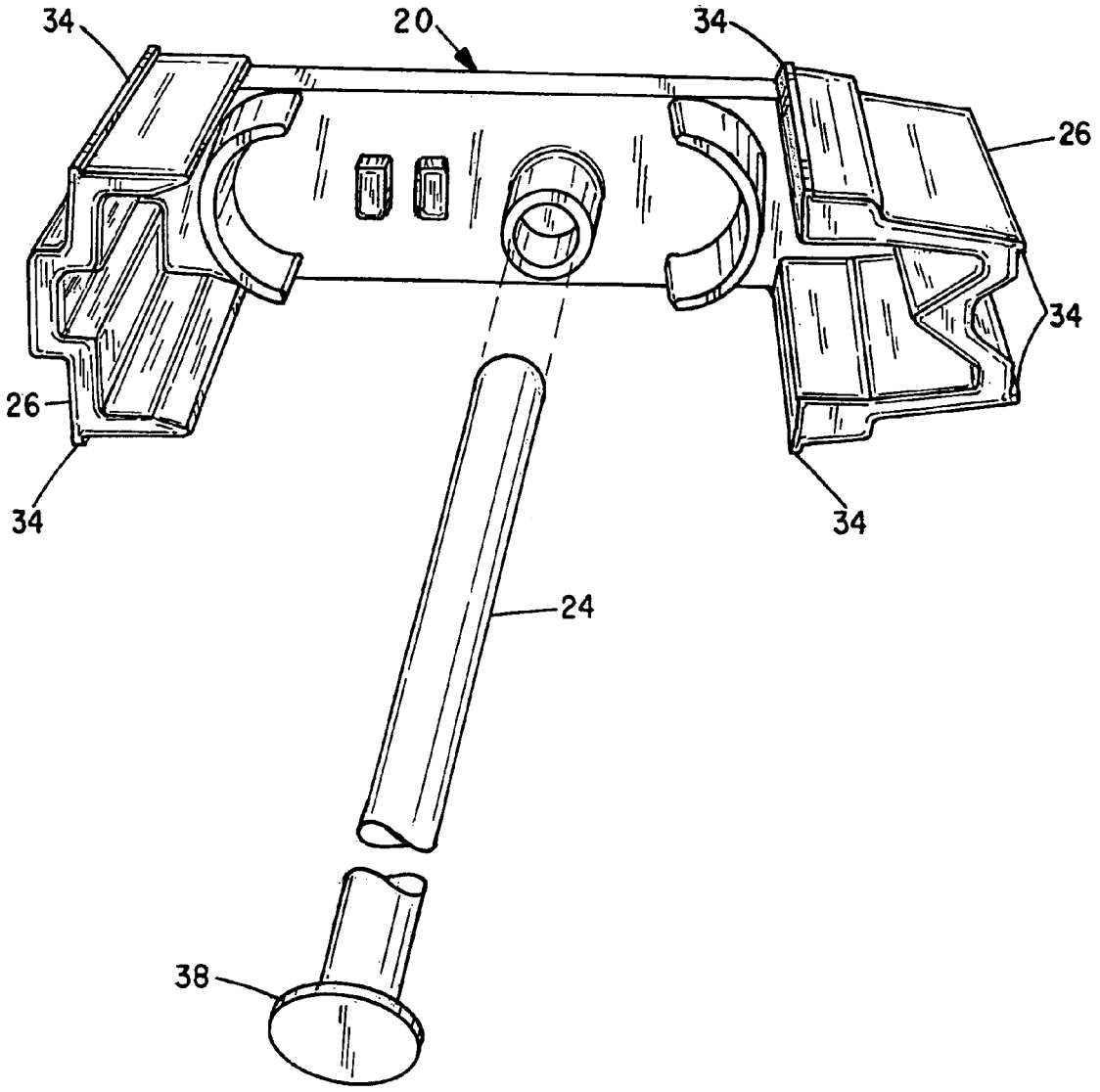
FIG. 4 is an enlarged view of the cartridge follower plate sans the cartridge magazine housing and spring from a different perspective showing a semi-permanently mounted or detachable stem or plug piece of suitable length that slip mounts or can be threaded to a collar or recess at the cartridge follower plate.

With attention to FIGS. 1-7 views are shown to a preferred and several alternative constructions of a firearm magazine assembly 10 that is adapted to contain differing numbers of cartridges (not shown). The assembly 10 is comprised of a base plate retainer collar 14 and a base plate 16, resistance spring 18 and cartridge follower plate 20 that are contained inside the cartridge magazine housing 22.

The housing 22 is adapted to fasten to a suitable firearm (not shown) having a receiver adapted to interlock the magazine assembly 10 to the firearm. The magazine assembly 10 is designed to contain a number of cartridges of a caliber matching the firearm. The magazine assembly 10, once inserted into the firearm, via the spring 18 and cartridge follower plate 20 elevates stored cartridges into alignment with the bore and firing pin at the receiver of the firearm as the firearm bolt is sequentially operated to load each round into the firing chamber.

The depicted magazine assembly 10 is of a "high capacity" type and is constructed to contain approximately 30 cartridges such as used with any caliber of rifle (e.g. .30-06, .308, 9 mm, .270, .223 caliber) and particularly an AR15. The magazine 10 can be designed to accommodate an AK47 rifle among a variety of semi-automatic sporting and military rifle designs. Such magazines are frequently used for range or target shooting due to the relatively heavy weight the fully loaded magazine presents and unrestricted range load limits.

The magazine housing 22 can be constructed to any shape and can be sized to contain any desired nominal maximum number of cartridges. Multiple magazines 10 might also be mounted or fastened together and located for rapid mounting to the firearm to reduce weapon re-loading time. Although one particular magazine assembly 10 adapted to an AR15 is shown, the invention is adaptable to magazine assemblies 10 of any shape and that accommodate any number and caliber of cartridge to permit ready modification to lesser storage capacities.

Conventional cartridge magazines accommodate any number of cartridges up to a maximum determined by the length of the magazine housing 22 and travel distance of the cartridge follower plate 20. In contrast, the improved magazine 10 of FIGS. 1-7 discloses a magazine assembly 10 wherein the base plate 16 and/or cartridge follower plate 20 include a permanently mounted or semi-permanently mounted projecting plug or stem piece 24. A permanently mounted plug piece 24 is however preferred and required in most legal jurisdictions having restricted magazine capacity laws/regulations.

The plug piece 24 is generally centered to project from an interior bottom surface 21 of the cartridge follower 20. The upper surface 23 of the cartridge follower plate 20 is configured to support and align cartridges stacked into the magazine housing 22 to properly feed into the firearm. Several tines 26 having raised surfaces depend in concentric orientation around the stem piece 24 and cooperate with the interior walls of the housing 22. The tines 26 include edge ridges 34 to maintain the relative orientation of the follower plate 20, spring 18 and loaded cartridges inside the magazine housing 22 to prevent tipping and assure a clean feeding of the cartridges into the firearm receiver.

The presently preferred plug piece 24 is permanently cast as a part of the cartridge follower plate 20 and is generally located to align with the center of the bore 28 of the spring 18. The length of the plug piece 24 is formed and/or may include scoring or notches 25 that permit sizing the length of the plug piece 24 to predetermined lengths. Other mechanisms can be included to adjust the length of the plug piece 24. For example, a multi-section telescoping plug piece 24, an interconnecting linear stack of plug pieces 24 or a threaded plug piece that screws into a protrusion that extends from the follower plate 20 and/or base plate 16. The selected length can thereby be established to limit the storage capacity of the magazine 10 to a predetermined lesser numbers of cartridges. For example, a full length plug piece 24 for a thirty cartridge magazine housing 22 might limit the magazine housing 22 to contain only five rounds. Shortening the plug piece 24 at a desired score/notch 25 or in another available fashion might increase the storage capacity to ten, fifteen or twenty rounds.

The plug piece 24 is presently sized to reduce the storage capacity of the depicted thirty cartridge magazine housing 22 to five cartridges. This number of cartridges is permitted under current hunting regulations in most states and jurisdictions which have limited the maximum cartridge capacity of a magazine.

Depending upon the established length of the plug piece 24 and as the magazine housing 22 is loaded with cartridges, the follower plate 20 and plug piece 24 depresses into the housing 22. The plug piece 24 is eventually directed into contact with a travel limiting surface, such as the interior surface of the base plate 16. It is to be appreciated the plug piece 24 might contact any desired surface within the magazine housing 22. It may also contact another plug piece projecting from the base plate 16. Otherwise, if the plug piece 24 was not present, the tines 26 would eventually contact the base plate 16 and accommodate the full thirty round storage capacity.

It is to be appreciated too that one or more plug pieces 24 might be adapted to extend from the tines 26 or other surface of the cartridge follower plate between the spring 18 and interior sidewalls of the cartridge housing 22 to strike the base plate 16. The plug piece(s) 24 might also be located to engage a cartridge limiting surface provided at the sidewalls of the cartridge housing 22.

In lieu of molding the plug piece 24 as part of the cartridge follower plate 20, a collar 36 (shown in dashed line) having a suitably shaped cavity or recess shaped to mate with the plug piece 24 is provided to secure the plug piece 24 to the cartridge follower plate 20 at a preferred extension. A variety of other attachments (some of which have been mentioned above, threaded etc.) can be provided at the cartridge follower plate 20 to interlock with the plug piece 24. The attachment mechanism and/or plug piece 24 might also permit the plug piece 24 to wobble and self-align at multiple internal angles relative to the magazine housing that accommodate straight walled or arcuate "banana-shaped" magazine housings 22.

The plug piece 24 can be constructed to any desired shape and size. It can be straight, exhibit an ellipsoidal, conical or other solid surface contour. The plug piece 24 might comprise or mount as an extension of one of the tines 26. The plug piece 24 might also include a head piece 38 that interacts with another plug piece that projects from the opposing base plate 16. The principal requirement is that the one or more plug pieces 24 mount within the magazine housing 22 and project sufficiently to restrict the total number of cartridges loaded into the magazine housing to something less than the possible maximum.

Figure 5:
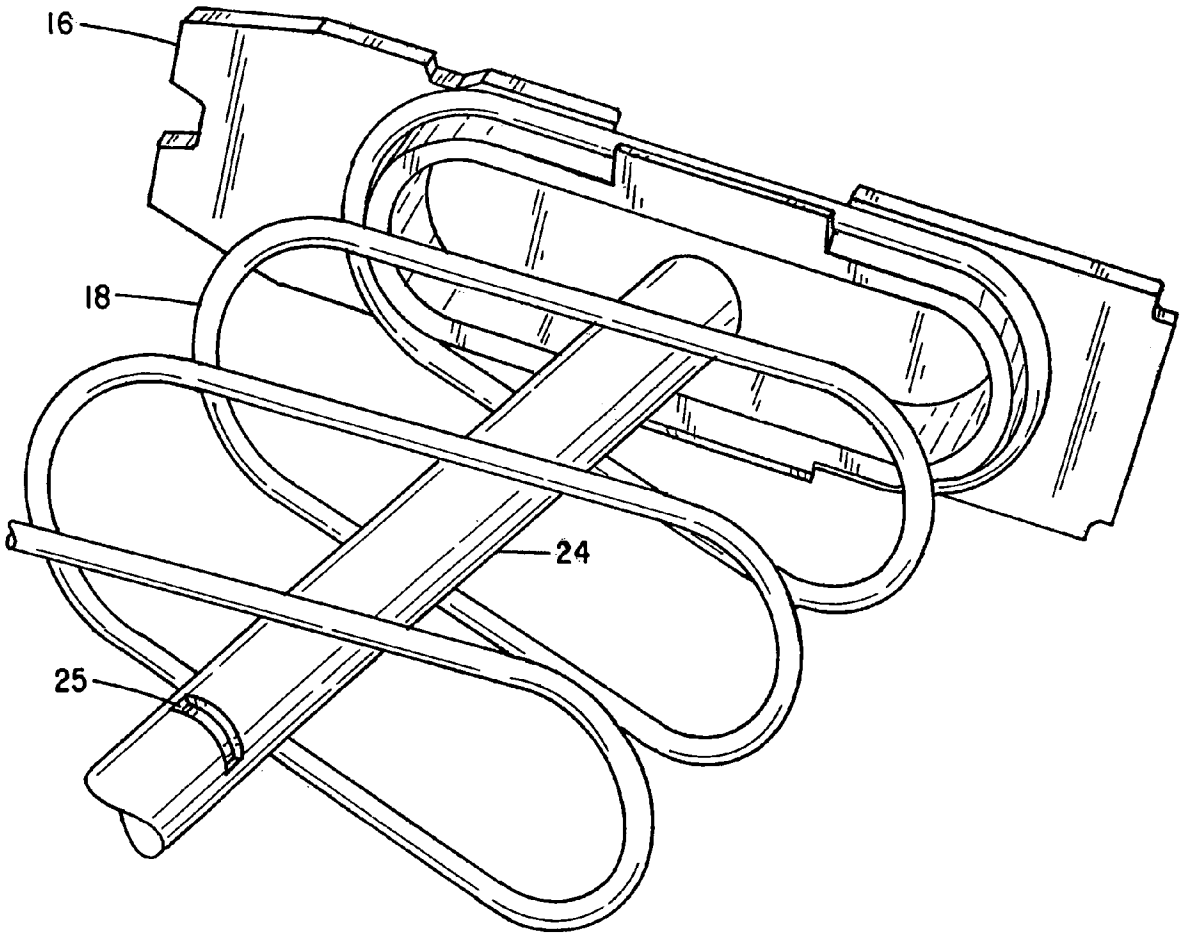
FIG. 5 is an enlarged view of a base plate sans the cartridge magazine housing showing a permanently mounted stem or plug piece sized to a suitable length that via included notches that projects into the bore of the resistance spring.
Figure 6:
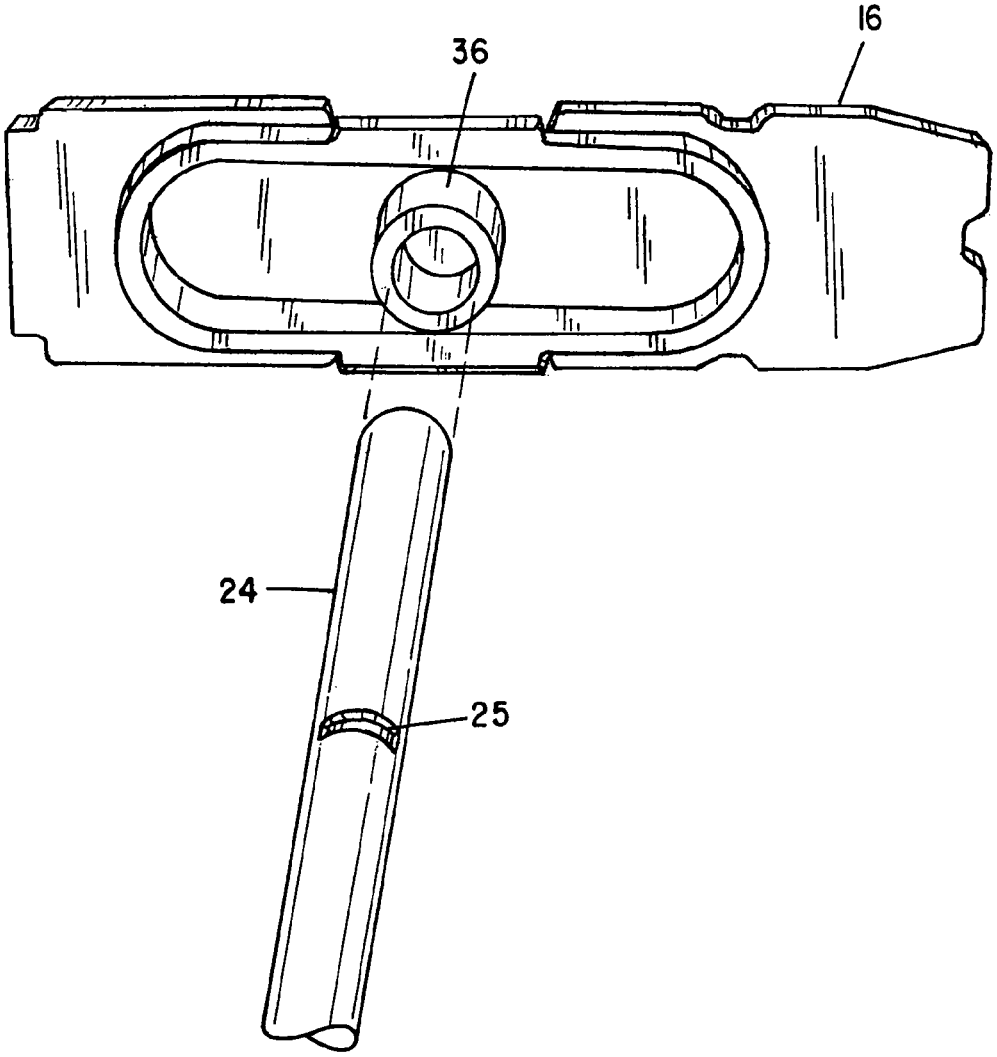
FIG. 6 is an enlarged view of a base plate sans the cartridge magazine housing and spring showing a semi-permanently mounted or detachable plug piece of suitable length (the length of which that can be tailored or threads or another length adjusting mechanism can be provided) that mounts to project from a collar or recess at the base plate.

FIGS. 5 and 6 depict a base plate 16 wherein the base plate 30 includes a projecting plug piece 24. The plug piece 24 is centered at a shaped interior surface of the base plate 16 and is aligned to project generally into the center bore 28 of the resistance spring 18. The plug piece 24 projects to restrict and shorten the travel distance of the cartridge follower plate 20. In lieu of the tines 26 contacting the base plate 16, the cartridge follower plate 20 contacts the distal end of the plug piece 24. The extension of the plug piece 24 determines the cartridge storage capacity of the magazine housing 22 of the modified magazine assembly 10. The travel distance of the cartridge follower plate 20 might be limited via contact with other internal surfaces or structure contained in the magazine housing 22 or another plug piece 24 that depends from the follower plate 20.

The plug piece 24 of FIG. 5 is molded as a part of the base plate 16. Alternatively, the plug piece 24 of FIG. 6 is semi-permanently mounted to the base plate 16 in the bore of a projecting collar 36. In both instances the plug pieces 24 project sufficiently to prevent the tines 26 of the cartridge follower plate from contacting the base plate 16. The cartridge reduction is thereby determined by the restriction defined by the predetermined longitudinal displacement of the plug piece as it extends from the base plate 16.

Figure 7:
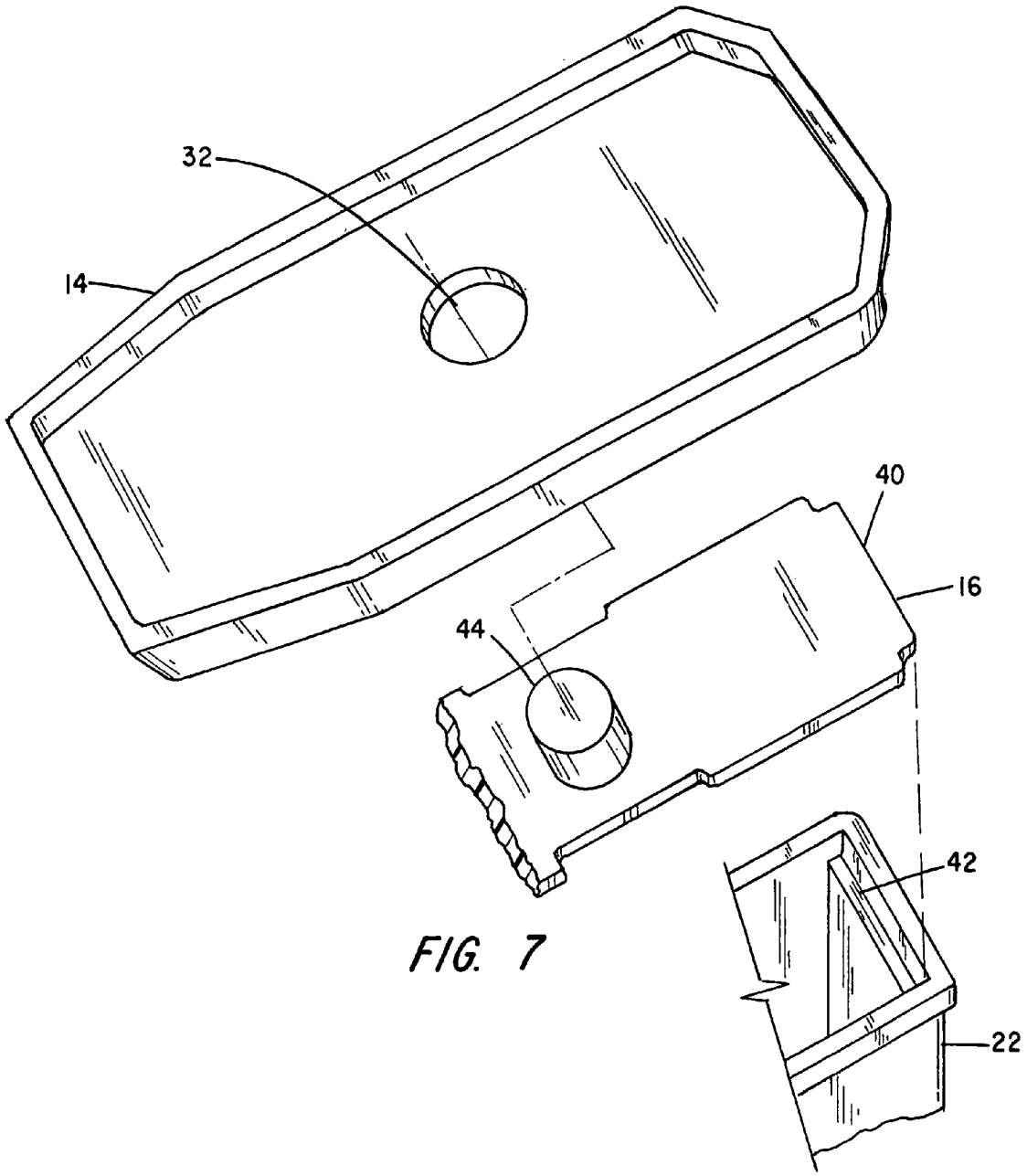
FIG. 7 is an enlarged view of the bottom side of the base plate and overlying base plate collar relative to a pivot ledge at the magazine housing and a latching base plate projection that cooperate to secure the base plate to the cartridge magazine housing and permit inserting or removing a plug piece to accommodate the shooting venue.

With further attention to FIG. 7, and enlarged perspective view is shown to the latching action of the base plate retainer collar 14 to the magazine housing 22. The retainer collar 14 enables the insertion and retention of a suitably improved base plate 16 and/or cartridge follower plate 20 (i.e. containing a plug piece 24) as described above into the magazine housing 20. The retainer plate 14 includes a transverse channel, flange or groove that interlocks or latches with a flanged end of the magazine housing 22 once the cartridge follower plate 20, spring 18 and base plate 16 are inserted into the housing 22. With the final insertion of the base plate 16, an edge 40 is aligned to overlap a ledge 42 in the cartridge housing 22. An opposite edge of the base plate 16 is then depressed or levered into the cartridge housing 22 sufficiently to permit the retainer collar 14 to slip onto the end of the cartridge housing 22. The retainer collar 14 is then moved laterally until a latch piece 44 that protrudes from the bottom of the base plate 16 is captured at an aperture 32 in the retainer plate 14.

Once assembled with base and/or cartridge follower plates 16, 20 containing suitable plug piece(s) 24, the magazine assembly 10 provides a reduced capacity cartridge storage space. The capacity of which as mentioned can be tailored to accommodate pertinent laws. The magazine assembly 10 is returned to its full capacity upon merely extracting the plug piece(s) 24 or replacing the modified cartridge follower or base plates 20, 16 with unmodified plates 20, 16.

While the invention is shown and described with respect to several presently preferred embodiments of firearm magazines and several considered improvements, modifications, combinations and/or alternatives thereto, still other assemblies and arrangements may be suggested to those skilled in the art. It is to be appreciated therefore that the features of the foregoing magazine assembly can be arranged in different combinations. The foregoing description should therefore be construed to include all those embodiments within the spirit and scope of the following claims.

What is claimed is:

1. A firearm cartridge magazine comprising:

a) a magazine housing having a storage capacity sufficient to contain a predetermined maximum number of cartridges within an internal storage space;

b) a base plate adapted to mount to said magazine housing and cover one end;

c) a retainer collar adapted to fasten to said magazine housing and interlock with said base plate and removeably latch said base plate to said magazine housing;

d) a cartridge follower plate adapted to reciprocally move to and fro in said magazine housing and having a surface shaped to support and align a plurality of cartridges in generally parallel relation to each other and transverse to sidewalls of said housing;

e) a resistance spring compressively mounted between said base plate and said cartridge follower plate; and f) plug means for reducing the range of longitudinal movement of said cartridge follower plate to less than a possible maximum range to reduce the number of storable cartridges to less than the maximum number, wherein said plug means comprises first and second elongated plug pieces that respectively protrude from said base plate and said cartridge follower plate and contact each other as said cartridge follower plate is depressed to reduce the storage capacity to less than the predetermined maximum number of cartridges.

2. A magazine as set forth in claim 1 wherein said first and/or said second plug piece is mounted to be removable from said cartridge follower plate or said base plate.

3. A magazine as set forth in claim 1 wherein at least one of said first and/or second plug pieces includes means for shortening the length of said first and/or second plug piece and thereby the combined length of said first and second plug pieces.

4. A plug for a firearm cartridge magazine comprising a follower plate adapted to mount in a tubular magazine housing having a storage space sized to contain a maximum number of cartridges, wherein the interior of the magazine housing is shaped to store the cartridges in generally parallel alignment to each adjacent cartridge, wherein the cartridge follower plate is adapted to reciprocally move to and fro in said magazine housing, wherein the cartridge follower plate includes an elongated plug piece that longitudinally depends from said cartridge follower plate and is positioned to contact a base plate of said magazine and has a length sized to limit the range of movement of said follower plate within said magazine housing to reduce the number of stored cartridges to less than said maximum number, wherein said plug member includes a plurality of notches displaced from each other predetermined distances and shaped to permit a selective shortening of the longitudinal length of the plug piece to increase the range of possible movement of the cartridge follower plate and the number of stored cartridges to a predetermined number less than the maximum number of storable cartridges.

5. A plug as set forth in claim 4 wherein the plug piece extends in the bore of a spring compressively supported between said follower plate and the base plate.

6. A plug as set forth in claim 4 including a second plug piece adapted to project from said base plate to strike the plug piece extending from the follower plate to collectively limit the range of movement of said follower plate.

7. A firearm cartridge magazine comprising:

a) a magazine housing having a storage capacity sufficient to store a predetermined maximum number of cartridges within an internal storage space;

b) a base plate adapted to mount to said magazine housing and cover one end;

c) a cartridge follower plate resiliently mounted and adapted to reciprocally move to and fro in said housing and having a surface shaped to support and align a plurality of cartridges in generally parallel relation to each other in said magazine housing; and d) a plug piece comprising an elongated member depending from said cartridge follower plate and positioned to longitudinally project to contact said base plate and limit the range of movement of said follower plate, wherein longitudinal length of said member is adapted to be sized to restrict the storage capacity of said magazine to a number of cartridges less than the maximum number, wherein said member includes a plurality of surface regions displaced from each other predetermined distances and each shaped to permit a selective breakage and shortening of the longitudinal length of the member to increase the range of possible movement of the cartridge follower plate and the number of stored cartridges to a predetermined number less than the maximum number of storable cartridges.

8. A magazine as set forth in claim 7 including a coiled spring having a bore defined by a plurality of windings and mounted in said magazine housing to resiliently support said cartridge follower plate relative to said base plate and adapted to compress as each cartridge is stored in said magazine, wherein said plug piece longitudinally projects in the bore of said spring, and including means for removeably securing said base plate to said magazine housing to selectively change out said cartridge follower plate and/or base plate.

9. A magazine as set forth in claim 7 wherein the plurality of displaced surface regions comprise a plurality of scored notches.

* * * * *